United States Patent [19]

Brautigam

[11] 4,134,273

[45] Jan. 16, 1979

[54] HOME HEATING AND COOLING SYSTEM

[76] Inventor: Robert F. Brautigam, P.O. Box 102, Agenda, Kans. 66930

[21] Appl. No.: 789,785

[22] Filed: Apr. 22, 1977

[51] Int. Cl.[2] ..... F25B 15/00; A25D 23/12; F24H 7/00

[52] U.S. Cl. ..... 62/141; 62/260; 62/476; 126/400; 165/45

[58] Field of Search ..... 62/2, 260, 476, 141; 165/45; 126/400

[56] References Cited

U.S. PATENT DOCUMENTS

| | | | |
|---|---|---|---|
| 2,396,338 | 3/1946 | Newton | 62/2 |
| 3,965,972 | 6/1976 | Petersen | 62/260 |
| 4,007,776 | 2/1977 | Alkasab | 62/2 |

*Primary Examiner*—Lloyd L. King
*Attorney, Agent, or Firm*—John A. Hamilton

[57] ABSTRACT

A home heating and cooling system consisting of a pair of large water tanks and a heat-operated absorption-type refrigeration system disposed between the tanks and operable to transfer heat from one tank to the other. The "hot" tank supplies hot water for operating a hot water home heating system, supplies a portion of the heat necessary to operate the refrigeration system, and may also operate a home hot water supply system, drawing heat from the "cold" tank and from the atmosphere through the refrigeration system. In periods of low heat demand, it may store large amounts of heat for later use in periods of higher demand, thereby reducing the heating load imposed on the refrigeration unit. The "cold" tank supplies a cold liquid for a home cooling system operable by such liquid, and the heat absorbed by said cooling system, together with heat absorbed from the atmosphere, is transferred to the hot tank by the refrigeration unit. The cold tank is capable of storing large quantities of cold water, or even ice, in periods of zero or low cooling demand, which may absorb the heat removed by the cooling system, whereby to reduce the cooling load on the refrigeration system in periods of higher demand for cooling.

14 Claims, 1 Drawing Figure

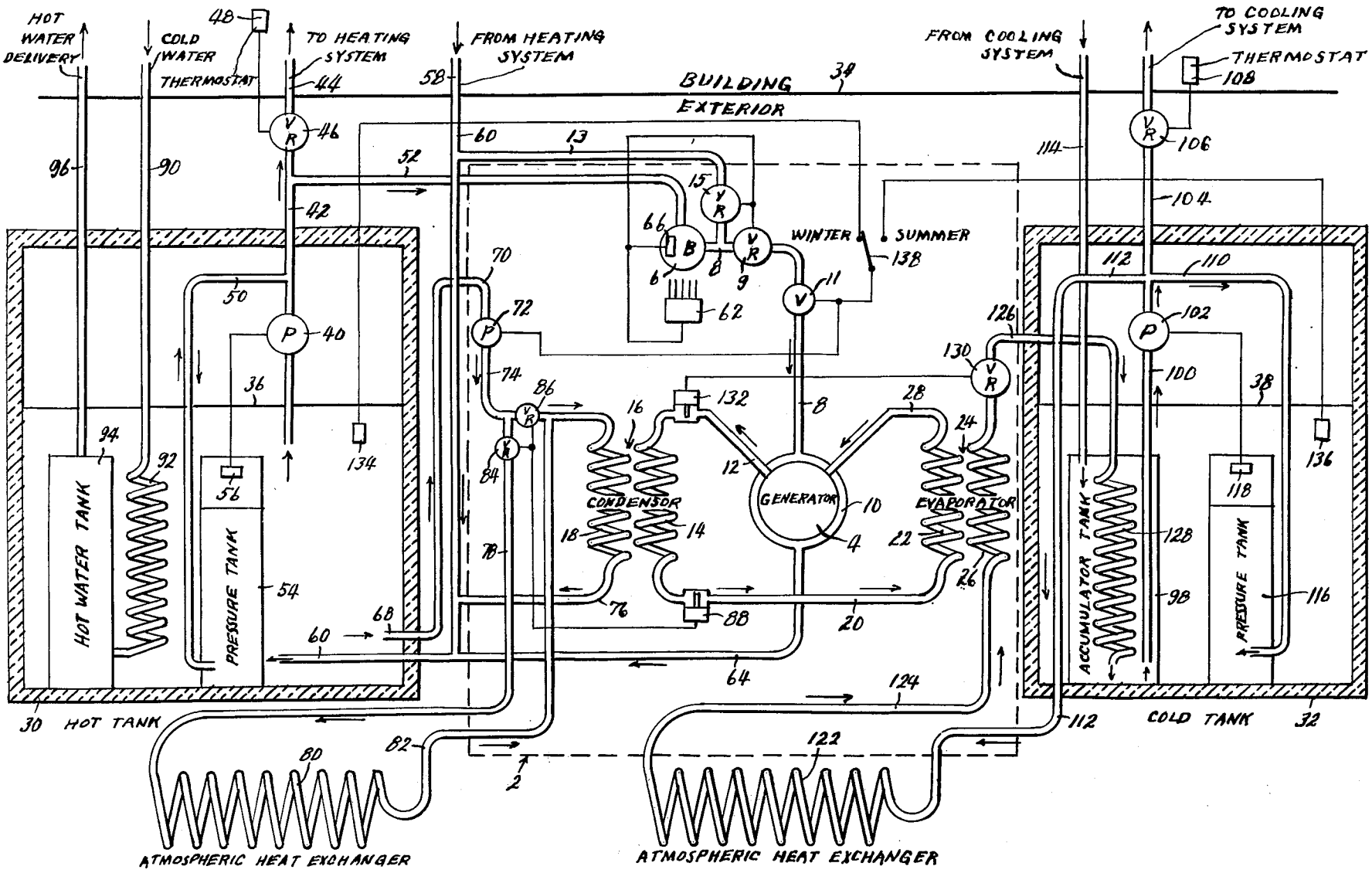
TO COOLING SYSTEM
THERMOSTAT
FROM COOLING SYSTEM
PRESSURE TANK
COLD TANK
ACCUMULATOR TANK
SUMMER
WINTER
BUILDING
EXTERIOR
EVAPORATOR
GENERATOR
CONDENSOR
ATMOSPHERIC HEAT EXCHANGER
FROM HEATING SYSTEM
TO HEATING SYSTEM
COLD WATER
THERMOSTAT
PRESSURE TANK
HOT WATER TANK
HOT TANK
HOT WATER DELIVERY

HOME HEATING AND COOLING SYSTEM

This invention relates to new and useful improvements in systems for operating heat transfer devices in houses and other buildings. It will be described as related to home heating and cooling devices, including a hot water supply system if desired, although it will be apparent that the system could, in some circumstances, be used to operate other devices such as refrigerators, freezers, clothes dryers and the like. The adaptability of the system for use with such other equipment will depend primarily on the development of such equipment, not to my knowledge presently available, operable by a supply of hot or cold fluid, since the present system supplies such fluids.

Most home heating and cooling systems waste a large share of the energy required to operate them. Aside from poor home insulation, which results both in the loss of much of the heat generated in the heating system to the atmosphere, and also in the absorption of much heat into the home which increases the load on the cooling system, such losses being capable of being greatly reduced by proper insulation of the home, the worst energy waster of the two is the cooling system of the home. Most cooling systems require a large amount of energy for their operation of removing heat from the zone being cooled, and then simply disperse the heat thus removed to the atmosphere. This represents an energy loss, since heat is of course one form of energy. If this heat could be captured and utilized for useful purposes, a substantial energy savings could be effected. The provision of means operable to accomplish this function is the primary object of the present invention.

Generally, this object is accomplished by the provision of a system including a cold water storage tank, a hot water storage tank, and a refrigeration system which acts as a heat pump for conveying heat from the cold tank to the hot tank. The refrigeration system produces a cold fluid for operating a home cooling system, and the heat removed from the home thereby is absorbed into the cold tank. In periods of zero or low demand for home cooling, the water in the cold tank becomes colder until possibly freezing, and thereby provides a reservoir of cold for absorbing heat from the cooling system for later use in periods of high cooling demand, to decrease the cooling load on the refrigeration system. The refrigeration system conveys heat from the cold tank to the hot tank, which supplies a hot liquid for operating the home heating system, and possibly also operates the home hot water system. In periods of zero or low demand for heat, the hot tank stores large quantities of heat for later use in periods of higher demand for heat.

Another object is the provision, in a combination heating and cooling system of the character described, of means operable to introduce atmospheric heat into the system during cold weather, when the hot tank may become starved for heat, and for dispersing heat from the system to the atmosphere in hot weather, when the temperatures in the hot tank may reach dangerously high levels.

A further object is the provision of a system of the character described wherein the refrigeration unit is heat-operated, and wherein heat from the hot tank is utilized to assist in driving the refrigeration unit, whereby to reduce the amount of externally supplied energy required to drive said unit.

Other objects are relative simplicity and economy of structure, and efficiency and dependability of operation.

With these objects in view, as well as other objects which will appear in the course of the specification, reference will be had to the accompanying drawing, wherein the single view is a schematic diagram of a home heating and cooling system embodying the present invention.

In the drawing, the refrigeration unit is indicated generally by the numeral 2. It is preferably of a heat-operated absorption type, which includes generally, though the diagram is highly simplified, a generator 4 in which a liquid refrigerant gas is heated and vaporized by a suitable heat source, in this case hot water heated in a boiler 6 and conveyed by a conduit 8, through a regulating valve 9 and a control valve 11, to circulate through a jacket 10 surrounding the generator. Intermediate boiler 6 and valve 9 a conduit 13 is interconnected into conduit 8 and returns to the hot tank through a regulating valve 15. The vaporized gas is then conveyed by conduit 12 to the "hot" coil 14 of a condenser 16, where it is cooled and condensed by transfer of heat thereof to a relatively cool liquid circulating in the "cold" coil 18 of the condenser, then through a conduit 20 to the "cold" coil 22 of an evaporator 24, wherein it is expanded and hence greatly reduced in temperature to absorb heat from the "hot" coil 26 of the evaporator, and finally through conduit 28 back to the generator, where the cycle begins again and is continuously repeated. Thus the refrigeration unit acts as a heat pump, continuously moving heat from hot coil 26 of the evaporator to cold coil 18 of the condenser, or to the left as viewed in the drawing.

The system also includes a hot tank 30 and a cold tank 32, both being disposed outside of the walls 34 of the home or other building to which the system pertains, both being heavily insulated to minimize heat transfer through their walls, of as large capacity as is practically possible, at least 1,000 gallons being suggested, and respectively containing hot water and cold water to the water levels indicated respectively at 36 and 38. Hot water is removed from the hot tank by an electrically operated pump 40 and delivered through conduit 42 to a home heating system operable by hot water, as indicated at 44, through a thermostatically controlled regulating valve 46. Said valve is controlled by a thermostat 48 disposed in the space to be heated so as to open sufficiently to deliver only enough hot water to heat the space to the desired degree.

Intermediate pump 40 and valve 46, conduit 42 is provided with a pair of branch conduits 50 and 52 to which hot water is also delivered by the pump. Conduit 50 delivers water to the lower end of a pressure tank 54 disposed in the hot tank below the water level 36 thereof, whereby to pressurize air in said pressure tank above the water level therein. A pressure sensitive electric switch 56 disposed in the upper portion of the pressure tank controls pump 40, and is preset to turn said pump off when the pressure reaches a predetermined higher level, and to reactivate the pump when the pressure reaches a predetermined lower level. Thus hot water is delivered to the heating system by the pressure tank when the pump is not operating, and the pump need not operate continuously, particularly in periods of low demand on said pump. Water returning from the home heating system returns at 58, and is delivered directly back into the hot tank by conduit 60.

Conduit 52 delivers hot water from pump 40 (or from pressure tank 54) to boiler 6 of the refrigeration unit, where it is further heated by a gas burner 62 or other suitable externally fueled heating device, then delivered through conduit 8 to circulate in generator jacket 10, and finally back to the hot tank through conduit 64 and 60. When starting the system, the boiler water is of course cold, and cannot activate the generator until it is heated by burner 62. Said burner is controlled by a thermostat 66 disposed within the boiler, whereby to burn fuel at a maximum capacity only until the boiler water is sufficiently hot to initiate functioning of the generator, and thereafter to burn fuel only at a rate sufficient to maintain the boiler water at a temperature sufficient to provide optimum operation of the generator. Since the water delivered to the boiler from the hot tank is already heated to perhaps 150° to 180° F. after the tank reaches operating temperature, this reduces the amount of fuel necessarily consumed by burner 62, and hence reduces the external energy requirements of the system. As long as the hot tank water remains at a temperature capable of operating the refrigeration unit, say any temperature from 150° to 180° F., as during periods of low heat demand, burner 62 is shut off completely. However, if in periods of high heat demand, as in winter, the hot tank temperature drops below about 150° F., operation of the burner will be signalled by thermostat 66. Said thermostat also controls regulating valves 9 and 15, and if the hot tank temperature drops, indicating that the heat delivered by the refrigeration unit is insufficient to satisfy the demand for heat, said thermostat begins to throttle valve 9 and open valve 15, diverting variable portions of the hot water delivery of the boiler to generator 4, and back to the hot tank through conduits 13 and 60. The boiler may have a sufficiently high heat delivery capacity to supply the entire heating load of the home when valve 9 is completely closed and valve 15 completely open, thus rendering the heating system self-contained and independent of any other source of external energy. This condition may occur during sustained periods of cold weather when the heating demand is high and the supply of heat avaiable from the cold tank may be very low.

Water for circulation in the "cold" coil 18 of condenser 16 is withdrawn from the hot tank at 68 through conduit 70 by an electrically operated pump 72, which delivers said water through conduit 74 to coil 18, and from said coil back to the hot tank through conduits 76 and 60. In coil 18, it draws heat from the hotter fluids circulating in hot coil 14 of the condenser. It will of course be understood that coils 14 and 18 are so related as to provide maximum heat transfer therebetween, for example by forming them for coaxial tubes. Coils 22 and 26 of the evaporator are similarly arranged.

The water temperature in the hot tank must be maintained well below boiling, say no higher than 180° F., since higher temperatures might result in the generation of steam and hence possible pressure damage in the hot water circulating system. To prevent higher temperatures, conduit 74 between pump 72 and coil 18 is provided with a branch conduit 78 through which the flow from said pump may be diverted to an atmospheric heat exchanger 80, and from said exchanger through conduit 82 back to conduit 74 downstream from conduit 78, and a pair of flow proportioning valves 84 and 86 are interposed respectively in conduit 78, and in conduit 74 intermediate conduits 78 and 82, said valves being controlled by a temperature sensitive control 88 interposed in refrigerant gas conduit 20 at the outlet of condenser coil 14. As long as the water temperature entering coil 18 remains below the desired maximum limit, valve 84 remains closed and valve 86 fully open, so that no water circulates in exchanger 80. If the water temperature entering coil 18 starts to rise above the desired maximum limit, the temperature at control 88 will rise, since the refrigerant gases leaving the condenser will have been insufficiently cooled by the excessively hot water in coil 18. Control 88 then starts to open valve 84, and to throttle valve 86, whereby a portion of the water flow is diverted to exchanger 80 and further cooled therein. The heat transfer capacity of exchanger 80 should be sufficiently great, under all ambient atmospheric temperatures likely to occur, to dispose of all excessive heat necessary when valve 84 is fully open and valve 86 is fully closed. In very cold weather, when heat is supplied to the hot tank at a relatively low rate, valve 84 remains closed and valve 86 open, so that no water circulates in exchanger 80. To prevent possible freeze damage to the exchanger under these circumstances, it may be provided with any suitable means for draining it of water, not shown.

The heat stored in the water of the hot tank may also be used to operate the usual hot water system of the home, as shown. Cold water under pressure is delivered by conduit 90 to a heat exchanger 92 disposed in the hot tank beneath the water level therein, wherein it is heated, thence to a hot water tank 94 wherein it is stored and further heated, to be delivered on demand through conduit 96. The hot water in this system does not intermix with the water contained in the hot water tank.

The coolant fluid circulating in "hot" coil 26 of evaporator 24, and through the home cooling system, although warmer than "cold" coil 22 due to the extremely cold refrigerant gases in coil 22, is nevertheless very cold, leaving coil 26 at perhaps −20° F., and entering it at a higher temperature preferably much colder than the freezing point of water. The coolant fluid should thus be non-freezing at still lower temperatures, say to −40° F., and may for example consist of a mixture of water and anti-freeze solution in the proper proportions. It moves in a closed circulating system, and does not intermix with the water contained in cold tank 32. Coolant fluid for the home cooling system is withdrawn from an accumulator tank 98 disposed within the cold tank beneath the water level 38 thereof, through a conduit 100, by an electrically operated pump 102, and delivered by said pump through a conduit 104 to the home cooling system, through a regulating valve 106 which, as in the case of heating control valve 46, is regulated by a thermostat 108 disposed in the space to be cooled to pass only enough of the coolant fluid to satisfy the demand. The warmed coolant fluid is returned to accumulator 98 by a conduit 114. Intermediate pump 102 and valve 106, conduit 104 is provided with branch conduits 110 and 112. Branch 110 introduces the coolant under pressure into the lower portion of a pressure tank 116 to compress the air in said tank thereabove. A pressure sensitivie switch 118 disposed in the upper portion of the tank controls pump 102 to actuate it when the tank pressure drops below a preset level, and to deactuate it when said pressure rises above a preset higher level. Thus pump 102, in the same manner as pump 40, need not operate continuously, particularly in periods of low cooling demand.

Branch conduit 112 directs a portion of the delivery of pump 102 to a second atmospheric heat exchanger 122, from said exchanger through conduit 124 to "hot" coil 26 of evaporator 24, and from coil 26 back to the accumulator tank through conduit 126 and a heat exchanger coil 128 disposed within the accmulator tank, where it again intermixes with the warmed coolant returning from the home cooling system through conduit 114. The accumulator tank and heat exchanger 128 are elements of the refrigeration unit. The coolant returned to the accumulator by conduit 126, being much colder than that entering from conduit 114, absorbs heat from the latter and is warmed thereby. It is further warmed by the absorption of heat from the water of the cold tank, which is also much warmer than the coolant, and further in atmospheric heat exchanger 122, which even in winter weather carries a coolant fluid usually much colder than the atmosphere. Thus the heat collected by the coolant from all three of these sources, while contained in a cold medium, is conveyed to the "hot" coil of the evaporator, and extracted therefrom and "pumped" to the hot tank for further use by the action of the refrigeration unit, as previously described. Heat exchanger 122 is of course a form of solar heat collector, and solar units of other types could also be used to introduce heat into the system at this point.

During periods in which the demand of the hot tank for heat to be delivered thereto by the cold tank is high, as in cold weather, the temperature of the coolant in coil 26 may drop so low as to interfere with the optimum transfer of heat therefrom to coil 22, optimum efficiency requiring a fairly constant temperature differential between the two coils. This condition will be reflected by a drop of temperature at the inlet of condenser coil 14, since the refrigerant gas will have been inadequately warmed by its passge through the evaporator. This imbalance can be corrected by means of a regulating valve 130 interposed in the outlet conduit 126 of evaporator coil 26, regulated by a temperature sensitive control 132 interposed in refrigerent gas conduit 12 at the inlet of condenser coil 14. Whenever the temperature at this point drops below an optimum level, control 132 restricts valve 130 to reduce the flow rate in coil 26, by reducing the proportion of the delivery of pump 102 which is diverted to said coil. This reduced flow rate in coil 26 reduces the amount of heat which must be removed therefrom by coil 22 to preserve the desired temperature differential between the coils. Thus the controls 88 and 132 cooperate to provide the most efficient operation of the refrigeration unit which may be possible.

Of course the removal of heat from the water of the cold tank by the action of the refrigeration unit, as just described, reduces the temperature of the cold tank water, and when an amount of heat necessary to reduce it to freezing, plus the latent heat of fusion, has been removed, ice may form in the cold tank.

The latent heat is valuable to both the heating and the cooling systems. In operating the home cooling system in that it can provide ice into which heat returned to the accumulator can be dispersed, at the rate of latent heat of fusion, or about 144 B.t.u. per pound of water, before the ice melts and the cold tank temperature begins to rise, at which time the refrigeration unit must function to again remove heat from the cold tank. Thus the ice, if available, reduces the operating load on the refrigeration unit. In operating the heating system it provides a "well" of heat from which the hot tank may draw large quantities of heat without reducing the temperature of the cold tank or the temperature within evaporator coil 26. The latter would also increase the operating load of the refrigeration unit.

The operation of the system is believed to be reasonably self-evident from the foregoing description. Refrigeration unit 2 draws heat from cold tank 32, from atmospheric heat exchanger 122, and from the home cooling system when said system is operating, and conveys said heat into hot tank 30, where it is used both to assist in the operation of the refrigeration unit through boiler 6, and also of course to supply hot water to the home heating system when required. Of course, the home heating and cooling systems do not function simultaneously. When the cooling system is not operating, the refrigeration unit can draw heat only from the cold tank and from exchanger 122, with no other heat input into the cold tank, so that the cold tank temperature is reduced gradually to freezing, and after sufficient latent heat is further removed, ice forms in the tank. When the cooling system is operating, it deposits large quantities of heat into the cold tank, at a greater rate than the refrigeration unit can remove it, and the cold tank temperature will therefore eventually rise, but not until it has absorbed latent heat in the quantities necessary to melt any ice accumulated therein. As described, the ice thus forms a heat "well" into which large quantities of heat may be "dumped" to avoid increase of the heat removal load on the refrigeration unit, during periods when the demand of the hot tank for heat from the cold tank is low, and from which said heat may be recovered, again without increasing the operating load on the refrigeration unit, during periods of high heat demand by the hot tank.

Hot tank 30 of course supplies hot water at all times for assisting in the operation of boiler 6 of the refrigeration unit, whereby to reduce the quantity of fuel consumed by burner 62, and also for operating the home heating system when demanded by the opening of thermostatic valve 46. Any heat not consumed in the heating system, together with any heat not consumed at refrigerant gas generator 4, and any heat not lost from the "cold" coil 18 of condenser 16, is returned to the hot tank by conduit 60. When the heating system is operating, the demand for heat from the hot tank is high, so the hot tank temperature gradually drops as its reservoir of heat is consumed. When the heating system is not operating, the demand for heat from the hot tank is of course relatively low, and the temperature of the water therein rises. It cannot be allowed to boil and generate steam, since this could result in pressure damage to the system, so any excess heat in the tank is dispersed to the atmosphere through atmospheric heat exchanger 80 as previously described. This condition arises only in summer weather, so exchanger 80 is operative only in summer. Likewise, atmospheric heat exhanger 122 need be used only in winter, when the demand for heat from the cold tank is greatest. Therefore, a single atmospheric heat exchanger could serve both purposes, if a transfer valve were provided for alternatively routing either the flow circuit of condenser coil 18 or the flow circuit of evaporator coil 26 therethrough.

As thus far described refrigeration unit 2 operates continuously, except when effectively shut off by the closure of valve 9 and the opening of valve 15, when its operation would serve little useful purpose. Its primary function is not the creation of hot and cold zones, although these zones are necessary and the unit accomplishes both. So far as the present invention is concerned, the primary function of the refrigeration unit is the transfer of heat energy from zones wherein it is not then used or useful, and may be wasted, to zones wherein it may be utilized. Generally, it transfers heat from the cold tank, including at times normally wasted heat from the cooling system, to the hot tank, together with atmospheric heat and waste heat from the operation of the refrigeration unit, where said heat may be utilized for the heating system and for supplying operating energy for the refrigeration unit, while at the same time creating a zone of cold, or "negative heat" in the cold tank which assists in the operation of the cooling system. And while the system is not a "perpetual motion" device, it will be readily apparent that, depending on the heat storage capacities of the hot and cold tanks, the heating system could operate for substantial periods of time on the heat stored in the hot tank before requiring the delivery of heat thereto through the refrigeration system, and that the cooling system could operate for substantial periods of time by depositing heat therefrom into the cold tank. It is for this reason that the tanks should be as large as practically possible. Generally, the hot tank should be larger than the cold tank, since the former does not, as shown, have the capacity for storing latent heat as possessed by the latter. However, under some circumstances, the "cold" coil 18 of the condenser could be arranged to generate steam, and hot tank 30 to store the steam, so that latent heat could be utilized in this place of the system as well.

To permit the system to operate on stored heat whenever possible, the previously mentioned valve 11 is utilized. It is operated selectively either by a thermostat 134 set to open said valve whenever the temperature falls below a predetermined lower temperature, say 150° F., and to close said valve when the hot tank temperature rises above a predetermined higher level, say 180° F., or by a thermostat 136 set to open said valve whenever the cold tank water rises above a predetermined higher temperature, say 33° F., and to close said valve whenever said cold tank temperature falls below a predetermined lower level, say 25° F., at which time the cold tank water will be frozen. Thermostat 134 is used in winter, and thermostat 136 in summer, being rendered selectively operable by a manual selector switch 138. Either of said thermostats, whenever it signals closure of valve 11, also shuts off pump 72, and the refrigeration unit is effectively shut down. Thus when thermostat 48 signals a demand for heat in the heating system by opening valve 46, and the hot tank water has previously been heated above 150° F. by operation of the refrigeration unit during an earlier period of warmer weather, the heating system may be operated for a period of time, a substantial period if the capacity of the hot tank is high, before the temperature of the hot tank water drops sufficiently for thermostat 134 to restart the refrigeration unit by opening valve 11, at which time thermostat 66 also starts burner 62. Likewise, if thermostat 108 signals a demand for cooling by opening valve 106, and the cold tank water has previously been cooled to 25° F., by operation of the refrigeration unit in an earlier period of cooler weather, the cooling system may be operated for a period of time before the cold tank water is again heated to 33° F. and thermostat 136 signals restarting of the refrigeration unit. This time period also takes advantage of the latent heat of fusion which the cold tank absorbs before the ice therein melts and the water temperature begins to rise.

It is estimated that the present system, by its capture, storage and eventual utilization of heat energy either wasted or not utilized in previous separate heating and cooling systems, can reduce the external energy requirements for driving it by about one-half, as compared to the requirements of separate systems, with hot and cold tanks of 2,000 gallons capacity each. With larger tanks, the savings can be increased. In view of the present concern about shrinking natural energy resources, this saving is extermely important.

While I have shown and described a specific embodiment of my invention, it will be readily apparent that many minor changes of arrangement and operation could be made without departing from the spirit of the invention.

What I claim as new and desire to protect by Letters Patent is:

1. A home heating and cooling system comprising:

a. an insulated hot tank containing a hot liquid, b. an insulated cold tank containing a cold liquid, c. means operable to circulate hot liquid from said hot tank to a home heating system operable thereby, whereby said hot liquid is cooled, and to return said cooled liquid to said hot tank, d. means operable to circulate cold liquid from said cold tank to a home cooling system operable thereby, whereby said cold liquid is warmed, and to return said warmed liquid to said cold tank, and e. a continuously operable refrigeration unit operable to extract heat from said cold tank and to deposit the heat thus extracted into said hot tank, said refrigeration unit including heat absorbing elements, heat dispersing elements, means operable to circulate a refrigerant fluid continuously in a closed between said heat absorbing and heat dispersing elements of said unit, and means in said refrigerant fluid circuit whereby said fluid is rendered colder than said cold tank at said heat absorbing elements, and hotter than said hot tank at said heat dispersing elements, f. heat exchanger means operable by the temperature differential therebetween to transfer heat from said cold tank to said heat absorbing elements, and g. heat exchanger means operable by the temperature differential therebetween to transfer heat from said heat dispersing elements to said hot tank liquid.

2. A system as recited in claim 1 wherein said refrigeration unit includes a heat accumulating tank disposed in said cold tank beneath the level of the cold liquid therein, a coolant liquid much colder than said cold liquid being extracted from said accumulator tank to operate said home cooling system and returned to said accumulator tank to warm the cold liquid contained in said cold tank, and means for directing at least a portion of the coolant liquid extracted from said accumulator tank to the heat extracting elements of said refrigeration unit, where heat is extracted therefrom for conveyance to said hot tank, and thence returned to said accumulator tank where it absorbs further heat from said cold tank liquid.

3. A system as recited in claim 2 wherein said cold tank liquid constitutes water, and wherein the coolant liquid is maintained at a temperature well below the freezing point of water at all times by said refrigeration unit, whereby in periods of high demand for heat from the cold tank liquid, said liquid may be frozen to ice by the extraction of heat therefrom at the rate of the latent heat of fusion of water before the temperature of the cold tank liquid drops, and whereby in periods of low demand for heat from the cold tank the heat delivered to the cold tank by the cooling system may be dispersed into the cold tank, again at the rate of the latent heat of fusion of water, before the temperature of the cold tank liquid rises.

4. A system as recited in claim 3 wherein said refrigeration unit maintains the temperature of that portion of the coolant fluid circulated to the heat extracting elements of the refrigeration unit below the lowest ambient atmospheric temperature likely to occur, and with the addition of an atmospheric heat exchanger through which the coolant fluid circulating to said heat extraction elements passes, whereby it is further warmed by atmospheric heat.

5. A system as recited in claim 1 wherein said refrigeration unit is of a heat-operated type supplied with heat from a source external to the unit, and with the addition of means whereby a portion of the heat of said hot tank liquid is utilized to supply a portion of the heat required to operate said refrigeration unit.

6. A system as recited in claim 5 wherein a portion of the heat supplied to operate said refrigeration unit is not utilized, an with the addition of means operable to return any non-utilized portion of this heat to said hot tank.

7. A system as recited in claim 6 with the addition of means operable to return any heat extracted from said hot tank for operating said home heating system, and not utilized in said heating system, to said hot tank for later use.

8. A system as recited in claim 2 wherein said refrigeration unit is of a type operable by heat supplied thereto from a source external to itself, and including:

a. a first pump operable to circulate said hot tank liquid to said home heating system and to said refrigeration unit to supply operating energy thereto, b. a first thermostatically controlled valve operable to control the circulation of said hot tank liquid to said heating system but not to said refrigeration unit, c. a second pump operable to circulate said coolant liquid to said home cooling system and to the heat extracting elements of said refrigeration unit, and d. a second thermostatically controlled valve operable to control the circulation of said coolant liquid to said home cooling system but not to said refrigeration unit, whereby said refrigeration unit remains operative when either of said thermostatically controlled valves is closed.

9. A system as recited in claim 8 with the addition of a heating device powered by an external fuel source to further heat the hot tank liquid supplied by said first pump to operate said refrigeration unit, and a third thermostatically operable means operable to regulate said heating device to supply hot liquid of the desired temperature for operating said refrigeration unit, the rate of external fuel consumption thus depending on the temperature of the hot tank liquid supplied for operating said refrigeration unit.

10. A system as recited in claim 9 with the addition of:

a. a conduit for selectively delivering the hot tank liquid heated by said heating device back to said hot tank as well as to said refrigeration unit, and b. valve means operable to proportion the liquid output of said heating device between said hot tank and said refrigeration unit, and operable by said third thermostatic means to deliver a portion of the liquid output of said heating device to said hot tank whenever the temperature of the hot tank liquid drops below a predetermined minimum operating level, whereby to maintain said minimum operating temperature of the hot tank liquid.

11. A system as recited in claim 10 wherein said valve means operable to divide the liquid output of said heating device is operable to deliver the entire output to said hot tank, and wherein said heating device is of sufficient capacity to supply the entire heat demand of said hot tank whenever necessary.

12. A system as recited in claim 8 with the addition of:

a. a third thermostatically operable means operable to deactuate said refrigeration unit whenever the temperature of the hot tank liquid rises above a predetermined operating range and to actuate said refrigeration whenever the temperature of the hot tank liquid falls below said operating range.

b. a fourth thermostatically operable means operable to deactuate said refrigeration unit whenever the temperature of the cold tank liquid falls below a predetermination operating range and to actuate said refrigeration unit whenever the temperature of the cold tank liquid rises above said operating range, and c. manual selecting means whereby said third thermostatic means controls said refrigeration unit during winter weather, and said fourth thermostatic means controls said refrigeration unit during summer weather.

13. A system as recited in claim 12 wherein said cold tank liquid constitutes water, and wherein the upper and lower limits of the operating temperature range of said cold tank liquid lie respectively above and below the freezing temperature of water, whereby to take advantage of the latent heat of fusion in supplying heat to and removing heat from said cold tank liquid.

14. A system as recited in claim 8 wherein said hot tank liquid is water, whereby in periods of high input and low outlet of heat to and from said hot tank, said liquid may be boiled and pressurized steam generated, and with the addition of an atmospheric heat exchanger, and means operable to circulate said hot tank liquid through said atmospheric heat exchanger in any quantity necessary to maintain the temperature of said hot tank water beneath the boiling point of water.

* * * * *